US008458985B2

(12) United States Patent
Richardson et al.

(10) Patent No.: US 8,458,985 B2
(45) Date of Patent: Jun. 11, 2013

(54) FASTENER-RECEIVING COMPONENTS FOR USE IN CONCRETE STRUCTURES

(75) Inventors: George David Richardson, Vancouver (CA); Semion Krivulin, Richmond (CA)

(73) Assignee: CFS Concrete Forming Systems Inc., Vancouver (CA)

( * ) Notice: Subject to any disclaimer, the term of this patent is extended or adjusted under 35 U.S.C. 154(b) by 449 days.

(21) Appl. No.: 12/577,150

(22) Filed: Oct. 9, 2009

(65) Prior Publication Data

US 2010/0071304 A1 Mar. 25, 2010

Related U.S. Application Data

(63) Continuation-in-part of application No. 12/594,576, filed as application No. PCT/CA2008/000608 on Apr. 2, 2008.

(60) Provisional application No. 61/022,505, filed on Jan. 21, 2008, provisional application No. 60/986,973, filed on Nov. 9, 2007, provisional application No. 60/909,689, filed on Apr. 2, 2007.

(51) Int. Cl.

| | |
|---|---|
| ***E04B 1/00*** | (2006.01) |
| ***E04B 2/00*** | (2006.01) |
| ***E04B 1/38*** | (2006.01) |

(52) U.S. Cl.
USPC ..... 52/745.21; 52/367; 52/699

(58) Field of Classification Search
USPC ..... 52/367–371, 699–701, 745.21
See application file for complete search history.

(56) References Cited

U.S. PATENT DOCUMENTS

| | | | |
|---|---|---|---|
| 154,179 | A | 8/1874 | Hubert |
| 374,826 | A | 12/1887 | Clarke |
| 510,720 | A | 12/1893 | Stewart, Jr. |
| 820,246 | A | 5/1906 | Nidds |
| 1,035,206 | A | 8/1912 | Lewen |
| 1,080,221 | A | 12/1913 | Jester |
| 1,244,608 | A | 10/1917 | Hicks |

(Continued)

FOREIGN PATENT DOCUMENTS

| | | |
|---|---|---|
| CA | 0574720 | 4/1959 |
| CA | 0957816 | 11/1974 |

(Continued)

OTHER PUBLICATIONS

Vector Corrosion Technologies Marketing Materials, 2007.

(Continued)

*Primary Examiner* — William Gilbert
(74) *Attorney, Agent, or Firm* — Oyen Wiggs Green & Mutala LLP

(57) ABSTRACT

Fastener-receiving components are disclosed for use in a structure fabricated from a curable material (e.g. concrete, other cementitious materials or other curable materials). The fastener-receiving component comprises: one or more fastener-receiving channels, each fastener-receiving channel defined by a pair of longitudinally and inwardly extending sidewalls and comprising one or more break-through elements which extend longitudinally and transversely between the sidewalls for receiving fasteners that penetrate therethrough; and one or more anchor features that define one or more corresponding concavities shaped to receive liquid material when the structure is formed and to prevent outward movement of the fastener-receiving component when the liquid material cures. Kits and methods are provided for using the fastener-receiving components.

22 Claims, 12 Drawing Sheets

U.S. PATENT DOCUMENTS 1,276,147 A 8/1918 White
1,345,156 A 6/1920 Flynn
1,423,879 A 7/1922 Potter
1,637,410 A 8/1927 Corybell
1,653,197 A 12/1927 Barnes
1,715,466 A 6/1929 Miller
1,820,897 A 8/1931 White et al.
1,875,242 A 8/1932 Hathaway
1,915,611 A 6/1933 Miller
1,963,153 A * 6/1934 Schmieder ..... 52/373
2,008,162 A 7/1935 Waddell
2,050,258 A 8/1936 Bemis
2,076,472 A 4/1937 London
2,164,681 A 7/1939 Fould
2,172,052 A 9/1939 Robbins
2,326,361 A 8/1943 Jacobsen
2,861,277 A 11/1958 Hermann
2,892,340 A 6/1959 Fort
2,928,115 A * 3/1960 Hill ..... 16/16
3,063,122 A 11/1962 Katz
3,100,677 A 8/1963 Frank et al.
3,152,354 A 10/1964 Diack
3,196,990 A 7/1965 Handley
3,220,151 A 11/1965 Goldman
3,288,427 A 11/1966 Pluckebaum
3,291,437 A 12/1966 Bowden et al.
3,468,088 A 9/1969 Miller
3,545,152 A * 12/1970 Knohl ..... 52/367
3,555,751 A 1/1971 Thorgusen
3,588,027 A 6/1971 Bowden
3,788,020 A 1/1974 Gregori
3,886,705 A 6/1975 Cornland
3,951,294 A 4/1976 Wilson
3,991,636 A 11/1976 Devillers
4,023,374 A 5/1977 Colbert et al.
4,060,945 A 12/1977 Wilson
4,104,837 A 8/1978 Naito
4,106,233 A 8/1978 Horowitz
4,180,956 A 1/1980 Gross
4,276,730 A 7/1981 Lewis
4,351,870 A 9/1982 English
4,383,674 A 5/1983 Fricker
4,430,831 A 2/1984 Kemp
4,433,522 A 2/1984 Yerushalmi
4,434,597 A 3/1984 Fischer
4,508,310 A 4/1985 Schultz
4,532,745 A 8/1985 Kinard
4,543,764 A 10/1985 Kozikowski
4,550,539 A 11/1985 Foster
4,553,875 A 11/1985 Casey
4,575,985 A 3/1986 Eckenrodt
4,581,864 A 4/1986 Shvakhman et al.
4,606,167 A 8/1986 Thorne
4,695,033 A 9/1987 Imaeda et al.
4,703,602 A 11/1987 Pardo
4,731,964 A 3/1988 Phillips
4,731,971 A 3/1988 Terkl
4,742,665 A 5/1988 Baierl
4,856,754 A 8/1989 Yokota et al.
4,866,891 A 9/1989 Young
4,946,056 A 8/1990 Stannard
4,995,191 A 2/1991 Davis
5,014,480 A 5/1991 Guarriello et al.
5,124,102 A 6/1992 Serafini
5,216,863 A 6/1993 Nessa et al.
5,243,805 A 9/1993 Fricker
5,265,750 A 11/1993 Whiteley
5,311,718 A 5/1994 Trousilek
5,465,545 A 11/1995 Trousilek
5,489,468 A 2/1996 Davidson
5,491,947 A 2/1996 Kim
5,513,474 A 5/1996 Scharkowski
5,516,863 A 5/1996 Abusleme et al.
5,553,430 A 9/1996 Majnaric et al.
5,591,265 A 1/1997 Tusch
5,608,999 A 3/1997 McNamara
5,625,989 A 5/1997 Brubaker et al.
5,729,944 A 3/1998 De Zen
5,740,648 A 4/1998 Piccone
5,747,134 A 5/1998 Mohammed et al.
5,791,103 A 8/1998 Coolman
5,824,347 A 10/1998 Serafini
5,860,262 A 1/1999 Johnson
5,953,880 A 9/1999 De Zen
5,987,830 A 11/1999 Worley
6,161,989 A 12/2000 Kotani et al.
6,167,669 B1 1/2001 Lanc
6,167,672 B1 1/2001 Okitomo
6,189,269 B1 2/2001 De Zen
6,212,845 B1 4/2001 De Zen
6,219,984 B1 4/2001 Piccone
6,220,779 B1 4/2001 Warner et al.
6,247,280 B1 6/2001 Grinshpun et al.
6,387,309 B1 5/2002 Kojima
6,435,470 B1 8/2002 Lahham et al.
6,435,471 B1 8/2002 Piccone
6,530,185 B1 3/2003 Scott et al.
6,622,452 B2 9/2003 Alvaro
6,694,692 B2 2/2004 Piccone
6,832,456 B1 12/2004 Bilowol
6,866,445 B2 3/2005 Semler
6,935,081 B2 8/2005 Dunn et al.
7,444,788 B2 11/2008 Morin et al.
2003/0005659 A1 1/2003 Moore, Jr.
2003/0155683 A1 8/2003 Pietrobon
2004/0010994 A1 1/2004 Piccone
2004/0093817 A1 5/2004 Pujol Barcons
2005/0016083 A1 1/2005 Morin et al.
2005/0016103 A1 1/2005 Piccone
2006/0213140 A1 9/2006 Morin et al.
2009/0229214 A1 9/2009 Nelson
2010/0047608 A1 2/2010 Seccombe
2010/0050552 A1 3/2010 David et al.
2010/0071304 A1 3/2010 Richardson et al.
2010/0251657 A1 10/2010 Richardson et al.

FOREIGN PATENT DOCUMENTS

CA 1316366 4/1993
CA 2097226 11/1994
CA 2141463 8/1996
CA 2070079 6/1997
CA 2170681 8/1997
CA 2218600 6/1998
CA 2215939 8/1999
CA 2226497 10/1999
CA 2243905 1/2000
CA 2255256 1/2000
CA 2418885 8/2003
CA 2502343 5/2004
CA 2502392 5/2004
CA 2577217 1/2006
CA 2629202 4/2008
CA 2681963 10/2008
CH 317758 1/1957
DE 1684357 4/1967
DE 1812590 6/1970
DE 2062723 8/1972
DE 3003446 8/1981
DE 3234489 3/1984
DE 3727956 5/1988
DE 29803155 6/1998
EP 0025420 3/1981
EP 0055504 7/1982
EP 0141782 5/1985
EP 0757137 2/1997
FR 1381945 11/1964
FR 1603005 4/1971
FR 2535417 5/1984
FR 2721054 6/1994
FR 2717848 9/1995
GB 779916 7/1957
GB 2205624 12/1988
JP 05133028 5/1993
JP 09041612 2/1997
JP 2008223335 9/2008
SE 206538 8/1966
WO 8204088 11/1982

| | | |
|---|---|---|
| WO | 9500724 | 1/1995 |
| WO | 9607799 | 3/1996 |
| WO | 9635845 | 11/1996 |
| WO | 9743496 | 11/1997 |
| WO | 0065167 | 11/2000 |
| WO | 0163066 | 8/2001 |
| WO | 0173240 | 10/2001 |
| WO | 03006760 | 1/2003 |
| WO | 2004088064 | 10/2004 |
| WO | 2008119178 | 10/2008 |
| WO | 2009059410 | 5/2009 |
| WO | 2009092158 | 7/2009 |
| WO | 2010037211 | 4/2010 |
| WO | 2010078645 | 7/2010 |
| WO | 2010094111 | 8/2010 |

OTHER PUBLICATIONS

Vector Corrosion Technologies Marketing Materials, 2008.

Vector Corrosion Technologies Marketing Materials, 2005.

The Digigraph System, http://www.digigraph-housing.com/web/system.ht, accessed online Jan. 2012.

Digigraph Brochure, Building Systems using PVC extrusions and concrete, accessed online Jan. 2012.

Digigraph Guide, Digigraph Systems Inc., Installation Guide for the Digigraph Construction System Composed of PVC Extrusions and Concrete, accessed online Jan. 2012.

* cited by examiner

FASTENER-RECEIVING COMPONENTS FOR USE IN CONCRETE STRUCTURES

RELATED APPLICATIONS

This application is a continuation-in-part of U.S. application Ser. No. 12/594,576 which is a 35 U.S.C. §371 national phase entry application (having a national phase entry date of 2 Oct. 2009) of PCT/CA2008/000608 which has an international filing date of 2 Apr. 2008 and which claims the benefit of the priority of U.S. application No. 60/909689 filed 2 Apr. 2007, U.S. application No. 60/986973 filed 9 Nov. 2007 and U.S. application No. 61/022505 filed 21 Jan. 2008. U.S. applications Ser. No. 12/594,576, PCT application No. PCT/CA2008/000608, U.S. application No. 60/909689, U.S. application No. 60/986973 and U.S. application No. 61/022505 are all hereby incorporated herein by reference.

TECHNICAL FIELD

The invention disclosed herein relates to fabricating structures from concrete, other cementitious materials and/or other curable materials. Particular embodiments of the invention provide fastener-receiving components for use in such structures and methods for use of same.

BACKGROUND

It is known to make a wide variety of structures from concrete. By way of non-limiting example, such structures may include walls (e.g. for buildings, tanks or other storage containers), structural components (e.g. supports for bridges, buildings or elevated transportation systems), tunnels or the like.

In some applications, the concrete used to make such structures is unsuitable or undesirable as a surface of the structure or it is otherwise desired to line one or more surfaces of the structure with material other than concrete. By way of non-limiting example, bare concrete may be aesthetically unpleasing, may be insufficiently sanitary (e.g. for the purposes of housing food, animals and/or the like) and may be susceptible to degradation or damage from exposure to various chemicals or environmental conditions (e.g. exposure to salt, various acids, animal excrement, whey and/or the like). There is a general desire, therefore, to provide methods and/or apparatus for lining one or more surfaces of concrete structures with materials other than concrete.

In some applications, it is desired to mount other objects to structures fabricated from concrete. By way of non-limiting example such other objects may include surface linings, fascia, signage, solar panels, window frames, air conditioning components and the like. Currently widespread techniques for mounting objects to concrete are typically time consuming, inefficient and require specialized tools. There is a general desire to provide methods and/or apparatus for mounting objects to structures fabricated from concrete.

BRIEF DESCRIPTION OF THE DRAWINGS

In drawings which depict non-limiting embodiments of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

Aspects of the invention provide fastener-receiving components for use in structures fabricated from concrete and/or other curable materials and methods for using same. In particular embodiments, fastener-receiving components comprise one or more fastener-receiving channels, each fastener-receiving channel comprising one or more break-through elements through which fasteners may penetrate when projected into fastener-receiving channels. Break-through elements may be shaped to provide concavities (e.g. V-shaped concavities) which open outwardly such that when fasteners penetrate from the concave side of a break-through element to the other side of the break-through element, it is relatively difficult to withdraw the fastener from the break-through element using outwardly directed force.

In particular embodiments, fastener-receiving components are located in a vicinity of an exterior surface of a structure fabricated from concrete (or other similar curable material). With fastener-receiving components located in a vicinity of such exterior structural surfaces, fasteners may be used to mount other objects to the exterior structural surface by projecting into the fastener-receiving components. Fastener receiving components may be elongated in one longitudinal dimension and have substantially uniform cross-section in this longitudinal dimension. In use, the longitudinal dimension may be substantially parallel with the exterior structural surface.

In particular embodiments, fastener-receiving components are provided with anchoring features and are embedded into concrete (or similar curable material) during the process of forming a structure. Anchoring features may be shaped to provide concavities between the anchoring feature and the surface of the resultant structure, so that the fastener-receiving components are anchored to the resultant structure when the concrete (or other similar curable material) cures. In some embodiments, anchoring features may be shaped to provide a stem that extend inwardly away from an inner surface of the fastener-receiving channel(s) and one or more leaves that extend transversely from the stem at locations spaced inwardly apart from the inner surface of the fastener-receiving channel(s).

Figure 1A:
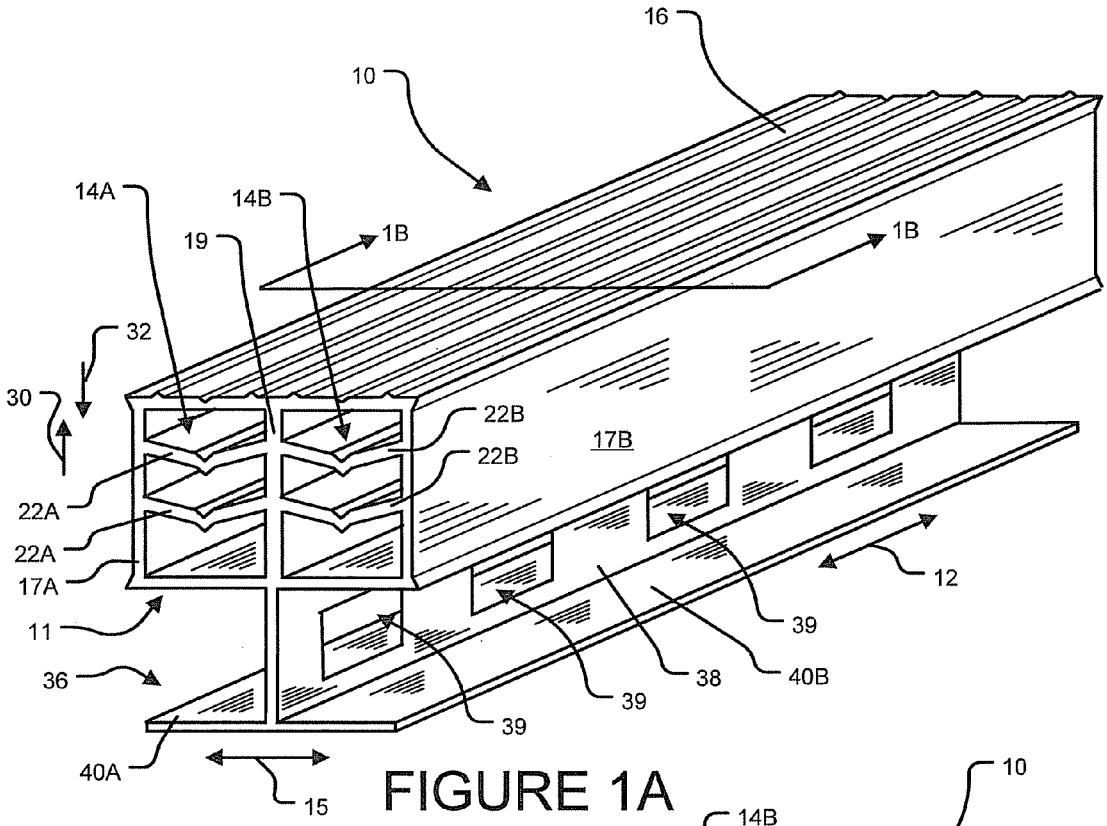
FIG. 1A is an isometric view of a fastener-receiving component according to a particular embodiment of the invention.
Figure 1B:
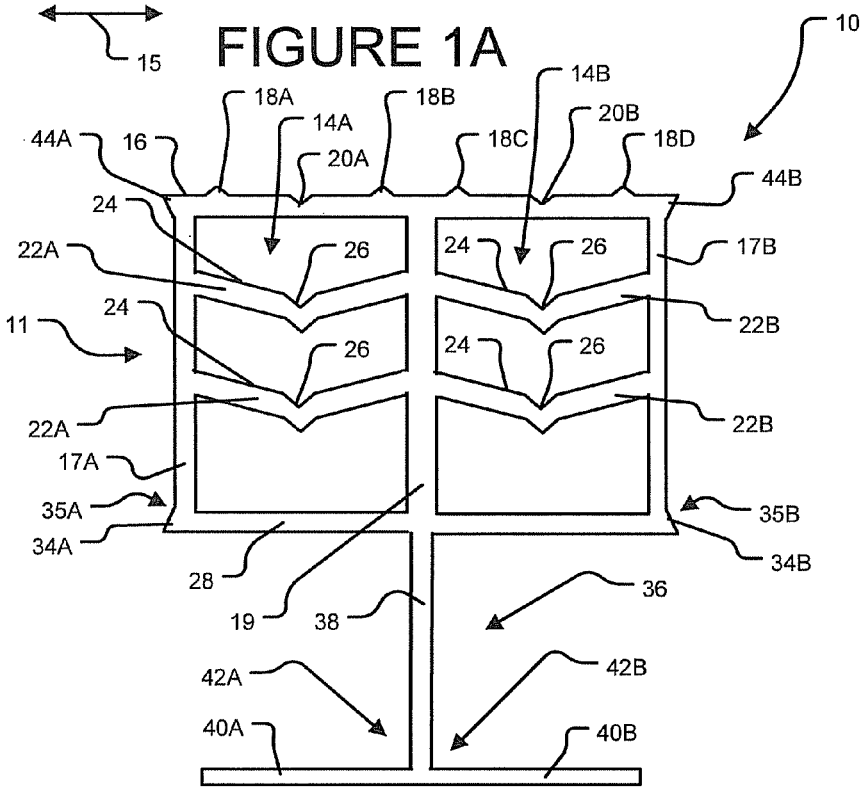
FIG. 1B is a cross-sectional view of the FIG. 1A fastener-receiving component taken along the line 1B-1B.

FIGS. 1A and 1B respectively depict isometric and cross-sectional views of a fastener-receiving component 10 according to a particular embodiment of the invention.

Fastener-receiving component 10 of the illustrated embodiment extends in a longitudinal direction (shown by double-headed arrow 12 of FIG. 1A). Except where specifically noted in this description or the drawings, fastener-receiving component 10 may have a substantially uniform cross-section over its longitudinal dimension and the extension of various features in the longitudinal direction (double-headed arrow 12) is not expressly described.

In particular embodiments, fastener-receiving component 10 is fabricated from suitable plastic as a monolithic unit using an extrusion process. By way of non-limiting example, suitable plastics include: poly-vinyl chloride (PVC), acrylonitrile butadiene styrene (ABS) or the like. In other embodiments, fastener-receiving component 10 may be fabricated from other suitable materials, such as fiberglass, steel or other suitable alloys or composite materials (e.g. a combination of one or more resins and natural and/or synthetic materials), for example. Although extrusion is one particular technique for fabricating fastener-receiving components 10, other suitable fabrication techniques, such as injection molding, stamping, sheet metal fabrication techniques or the like may additionally or alternatively be used.

In the illustrated embodiment, fastener-receiving component 10 comprises a fastener-receiving portion 11 which includes a pair of fastener-receiving channels 14A, 14B (collectively fastener-receiving channels 14). Fastener-receiving channels 14 are located adjacent to one another in a transverse direction indicated by double-headed arrow 15. Although a pair of transversely adjacent fastener-receiving channels 14A, 14B are shown in the illustrated embodiment, fastener-receiving component 10 may generally comprise any suitable number of fastener-receiving channels 14. In the illustrated embodiment, transversely adjacent fastener-receiving channels 14A, 14B each comprise a sidewall 17A, 17B (collectively, sidewalls 17) and share a central side wall 19. Transversely adjacent fastener-receiving channels 14 need not share a common sidewall 19 and each fastener-receiving channel may 14 generally comprise a pair of transverse sidewalls.

Fastener-receiving portion 11 may comprise a an exterior receiver surface 16 which covers fastener-receiving channels 14. In the illustrated embodiment, exterior receiver surface 16 comprises a number of small ridges 18A, 18B, 18C, 18D (collectively, ridges 18) and a number of small grooves 20A, 20B (collectively, grooves 20). Ridges 18 and grooves 20 may be used to temporarily connect fastener-receiving component 10 to a form-work element as discussed in more detail below. Convexities 18 and concavities 20 are not necessary. In general, exterior receiver surface 16 may be flat or may otherwise conform to the shape of a concrete structure into which fastener-receiving component 10 may be anchored as explained in more detail below. In other embodiments, exterior receiver surface 16 may be provided with different numbers of ridges 18 and/or grooves 20.

Fastener-receiving channels 14 may comprise one or more break-through elements 22. In the illustrated embodiment, each fastener receiving channels 14 each comprise a pair of break-through elements 22 (i.e. fastener-receiving channel 14A comprises a pair of break-through elements 22A and fastener-receiving channel 14B comprises a pair of break-through elements 22B). Break-through elements 22A and 22B are referred to collectively herein as break-through elements 22. In currently preferred embodiments, each fastener-receiving channel 14 comprises a plurality (e.g. between 2-10) break-through elements 22. In general, however, fastener-receiving channels 14 may comprise any suitable number of break-through elements 22 which may depend, for example, on the type of fastener proposed to be used with fastener-receiving component 10 and/or the fastening strength required for a given application.

In the illustrated embodiment, each break-through element 22 comprises a concave surface 24 which faces toward exterior receiver surface 16. As shown best in FIG. 1B, concave surfaces 24 may be generally V-shaped in cross-section. While concave surfaces 24 are not a necessary feature of break-through elements 22, concave surfaces 24 can increase the fastening strength of fastener-receiving components 10, as explained in more detail below. In the illustrated embodiment, concave surfaces 24 each comprise an optional groove region 26 where the slope of the concavity is relatively sharp in comparison to other regions of concave surfaces 24. These optional groove regions 26 may be located generally in a center of the transverse dimension 15 of break-through elements 22 and may help to guide fasteners toward the center of break-through elements 22, where break-through elements 22 may provide the greatest fastening strength. In some embodiments, the thickness of break-through elements 22 may be slightly reduced in groove regions 26 to allow fasteners to more easily penetrate break-through elements 22 as explained in more detail below.

Figure 1C:
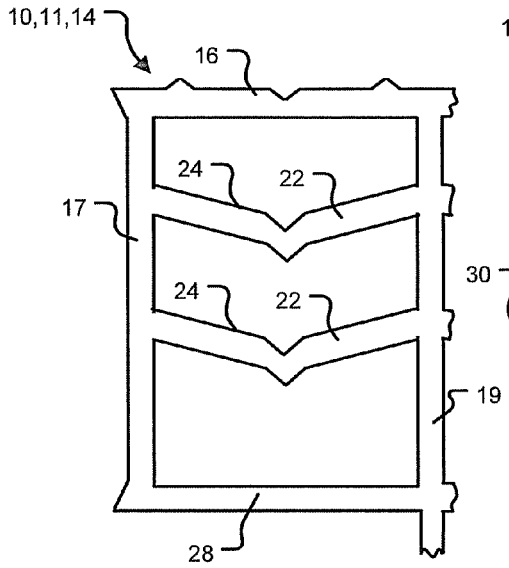
FIG. 1C shows cross-sectional view of a fastener-receiving channel of the FIG. 1A fastener-receiving component and FIG. 1D shows a fastener projecting into the FIG. 1C fastener-receiving channel.
Figure 1D:
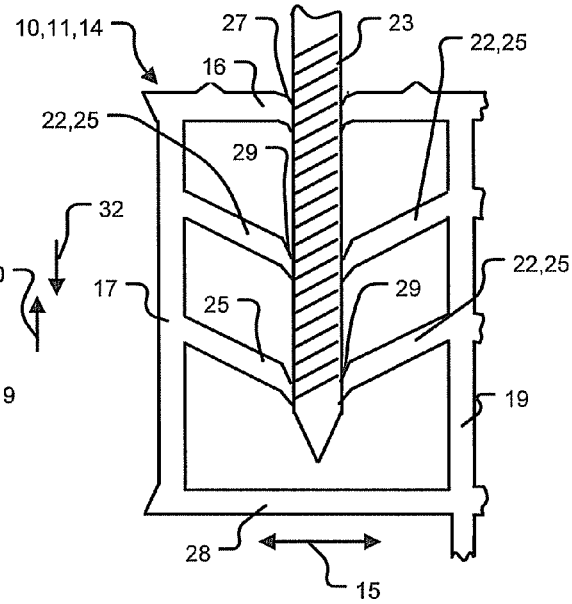

FIG. 1C shows cross-sectional view of a fastener-receiving channel 14 of fastener-receiving component 10 and FIG. 1D shows a fastener 23 projecting into fastener-receiving channel 14. As can be seen by comparing FIGS. 1C and 1D, when fastener 23 projects into fastener-receiving channel 14, fastener 23 penetrates through exterior receiver surface 16 and one or more of break-through elements 22. In the illustrated embodiment, fastener 23 projects through all of break-through elements 22 in fastener-receiving channel 14, but this is not necessary and fastener 23 may penetrate some subset of the break-through elements in fastener-receiving channel 14. Typically fastener 23 will be driven into fastener-receiving channel 14 using a power tool or a hand-operated tool. In the illustrated embodiment, where fastener 23 is a screw, fastener 23 may be driven into fastener-receiving channel 14 using a powered bit driver, a hand-operated screwdriver or the like. Fastener 23 need not be a screw and may comprise some other type of penetrative fastener, such as a nail, staple, rivet or the like.

When fastener 23 penetrates through exterior receiver surface 16 and one or more of break-through elements 22, fastener 23 may cause localized inward (i.e. in the direction of arrow 32) deformation of exterior receiver surface 16 and the penetrated break-through elements 22 in locations close to where exterior receiver surface 16 and break-through elements 22 are penetrated as is shown in locations 27 (of exterior receiver surface 16) and locations 29 (of break-through elements 22). When fastener 23 projects through break-through elements 22, it creates break-through fragments 25. Because of the concave exterior surfaces 24 of break-through elements 22, fastener 23 is prevented from retracting outwardly (i.e. in the direction of arrow 30), because the transverse width of opposing break-through fragments 25 (in the direction of double-headed arrow 15) is greater than the transverse width of fastener-receiving channel 14 between sidewalls 17, 19.

Figure 6A:
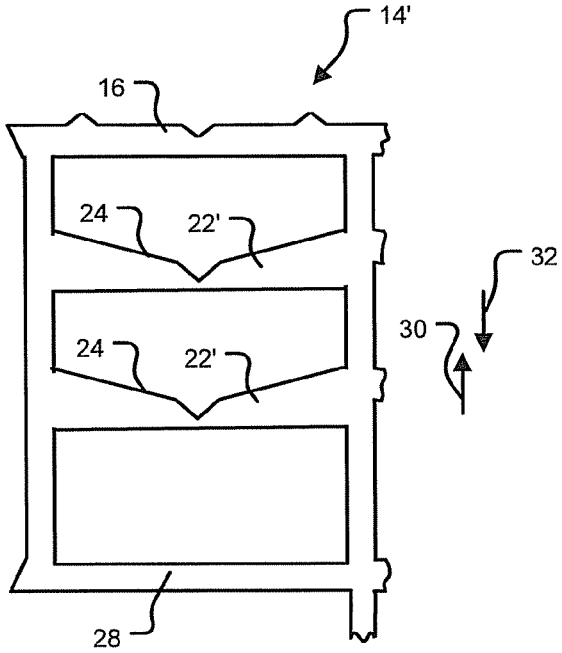
FIGS. 6A and 6B respectively depict cross-sectional views of fastener-receiving channels according to other embodiments comprising break-through elements that are different from those of the FIG. 1A fastener-receiving component.
Figure 6B:
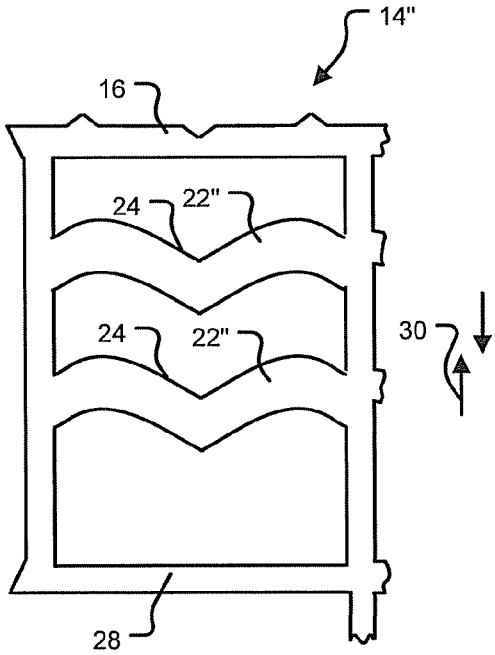

The shape of break-through elements 22 is not limited to the shape shown in fastener-receiving component 10 of the illustrated embodiment. In other embodiments, break-through elements 22 need not have concave surfaces 24 or groove regions 26. In some embodiments, concave surfaces 24 may occupy only a portion of the transverse dimensions of break-through elements 22. In some embodiments, break-through elements may comprise a plurality of groove regions 26. FIGS. 6A and 6B respectively depict cross-sectional views of fastener-receiving channels 14' and 14" comprising break-through elements 22' and 22" according to other embodiments. In fastener-receiving channel 14' of FIG. 6A, break-through elements 22' are substantially planar on their interior surfaces, but still provide concave exterior surfaces 24'. In fastener-receiving channel 14" of FIG. 6B, break-through elements 22" have a curved shape. Portions of exterior surfaces of break-through elements 22" are actually convex, but the central portion 24" of the exterior surfaces of break-through elements 22" are concave.

Fastener-receiving portion 11 of fastener-receiving component 10 may comprise an interior receiver surface 28 at an end opposite of fastener-receiving channels 14 opposite to exterior receiver surface 16. In this description, directions that extend parallel to the direction from interior receiver surface 28 toward exterior receiver surface 16 (as shown by arrow 30) may be referred to as outer, outward, outwardly, exterior directions or the like. Conversely, directions that extend parallel to the direction from exterior receiver surface 16 to interior receiver surface 28 (as shown by arrow 32) may be referred to as inner, inward, inwardly, interior directions or the like. As will be explained in more detail below, these directions have to do with the direction that fastener-receiving component 10 is oriented when anchored into a concrete structure.

Fastener-receiving component 10 is capable of being anchored into a concrete structure as the concrete structure cures. To facilitate such anchoring, fastener-receiving component 10 may comprise one or more anchoring features. In the illustrated embodiment, sidewalls 17A, 17B of fastener-receiving component 10 comprises one or more optional transverse anchoring protrusions 34A, 34B (collectively, transverse anchoring protrusions 34). Transverse anchoring protrusions 34 may be spaced inwardly from exterior receiver surface 16 to provide concavities 35A, 35B (collectively, concavities 35). Concavities 35 may receive liquid concrete when a concrete structure is being framed. Subsequently, when the concrete cures, the solidified concrete in concavities 35 will anchor fastener-receiving component 10 to the structure.

Figure 7A:
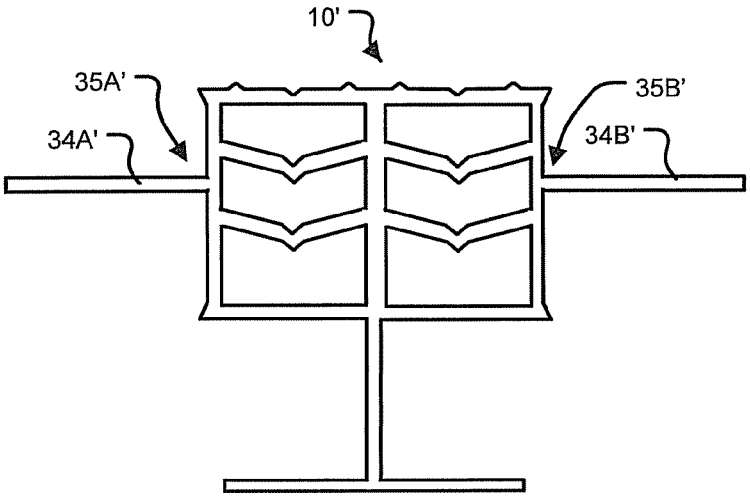
FIGS. 7A and 7B respectively depict fastener-receiving components according to other example embodiments which comprise transverse anchoring protrusions that are different from those of the FIG. 1A fastener-receiving component.
Figure 7B:
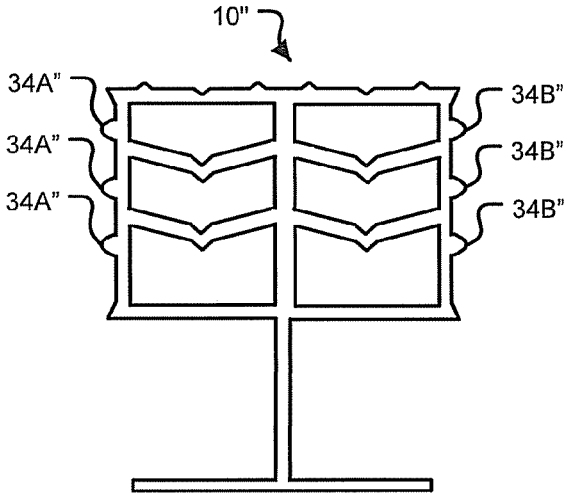

In the illustrated embodiment, each sidewall 17 of fastener-receiving component 10 comprises a single transverse anchoring protrusion 34, which is located at the union of sidewalls 17 with interior receiver surface 28. This is not necessary. In general, each sidewall 17 may comprise a plurality of transverse anchoring protrusions 34. In addition, while such transverse anchoring protrusions 34 are preferably located at location(s) spaced inwardly from exterior receiver surface 16, they need not be aligned with interior receiver surface 28. In addition to the number and location of transverse anchoring protrusions 34, the extent of the transverse projection of transverse anchoring protrusions 34 may also vary depending on the amount or anchoring strength required for fastener-receiving component 10 within the concrete structure. FIGS. 7A and 7B respectively depict fastener-receiving components 10', 10" according to other example embodiments which comprise transverse anchoring protrusions 34A', 34B' (collectively, 34') and transverse anchoring protrusions 34A", 34B" (collectively, 34") 'that are different from those of fastener-receiving component 10. In fastener-receiving component 10' (FIG. 7A), transverse anchoring protrusions 34' are located further inwardly on sidewalls 17 of fastener-receiving component 10'. Transverse anchoring protrusions 34' still provide corresponding concavities 35A', 35B'. Fastener-receiving component 10" (FIG. 7B) comprises a plurality of curved transverse anchoring protrusions 34" spaced apart along sidewalls 17 of fastener-receiving component 10". While concavities are not expressly enumerated in FIGS. 7A, 7B, it will be appreciated that transverse anchoring protrusions 34" still provide corresponding concavities.

In addition to transverse anchoring protrusions 34 on sidewalls 17 of fastener-receiving portion 11, fastener-receiving component 10 may comprise one or more optional anchor portions 36 which project inwardly (direction 32) from interior receiver surface 28. In the illustrated embodiment, fastener-receiving component 10 incorporates an anchor portion 36 which comprises a stem 38 extending inwardly (direction 32) from interior receiver surface 28 and a pair of leaves 40A, 40B (collectively, leaves 40) which project transversely (directions 15) from stem 38 at locations spaced inwardly apart from interior receiver surface 28. As shown best in FIG. 1A, stem 38 may comprise one or more apertures 39 spaced apart from one another in the longitudinal direction 12 to permit concrete flow and/or the extension of reinforcement bars (rebar) therethrough. In some embodiments, the edges of apertures 39 may comprise concavities shaped to hold rebar, as described in U.S. application Ser. No. 12/594,576. The spacing of leaves 40 away from interior receiver surface 28 provides concavities 42A, 42B (collectively, concavities 42). In a manner similar to that of concavities 35 provided by transverse anchoring protrusions 34, concavities 42 may receive liquid concrete when a concrete structure is being formed. Subsequently, when the concrete cures, the solidified concrete in concavities 42 will anchor fastener-receiving component 10 to the structure.

Anchor portion 36 is not necessary. In some applications, transverse anchoring protrusions 34 on sidewalls 17 provide sufficient anchoring strength to anchor fastener-receiving component 10 to concrete structures. In some embodiments, fastener-receiving component 10 comprises a plurality of anchor portions 36. Anchor portions 36 may have different shapes than that shown in the illustrated embodiment. In some embodiments, anchor portions 36 may comprise inwardly extending stems which have different shapes that stems 38 of the illustrated embodiment and/or one or more transversely extending leaves that have different shapes than leaves 40 of the illustrated embodiment. Such alternative stems and/or leaves may still provide one or more concavities 42 between the leaves, stems and interior receiver surface 28 which receive liquid concrete to anchor fastener-receiving components 10 to concrete structures. The dimensions of stems 38 and leaves 40 (e.g. the inward extension of stem 38 and the transverse extension of leaves 40) may also vary depending on the anchoring strength required for a particular application. In other embodiments, stems and/or leaves are not required and anchoring portions may comprise other transversely extending shapes/structures which provide similar concrete receiving concavities. In one particular embodiment, an anchor portion may be provided with stem 38 and no leaves 40. Anchor portion 36 may be anchored to concrete structures by concrete which flows through apertures 39.

Figure 8A:
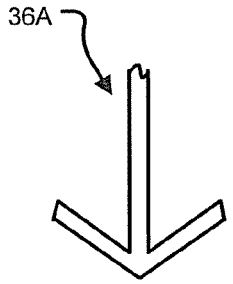
FIGS. 8A-8C show a number of exemplary anchor portions according to other embodiments.
Figure 8B:
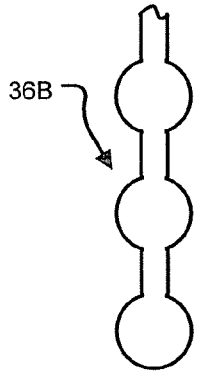
Figure 8C:
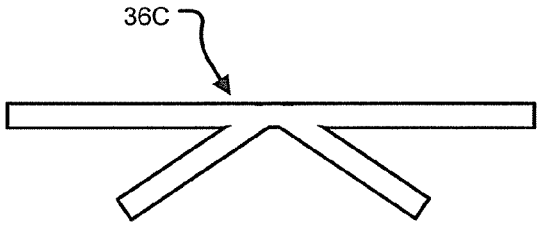

FIGS. 8A-8C show a number of exemplary anchor portions 36A, 36B, 36C according to other embodiments. Anchor portion 36A (FIG. 8A) comprises a stem and angular leaves. Anchor portion 36B (FIG. 8B) comprises a stem and curved leaves which extend transversely from the stem. Anchor portion 36C (FIG. 8C) comprises a pair of angular leaves without a stem. It will be appreciated that the anchor portions 36A, 36B, 36C each provide concavities which (when filled with concrete) will anchor their corresponding fastener-receiving component to a concrete structure.

Fastener-receiving component 10 may also comprise one or more temporary connecting features 44 which may be located at or near exterior receiver surface 16. In the illustrated embodiment, fastener-receiving component 10 comprises a pair of temporary connecting features 44A, 44B (collectively, connecting features 44) which comprise outward transverse projections from sidewalls 17 in a vicinity of exterior receiver surface 16. As explained in more detail below, temporary connecting features 44 may form temporary "snap-together" with corresponding connecting features on mounting guides to temporarily connect fastener-receiving component 10 to a desired location on a form-work element until the concrete cures and anchors fastener-receiving component 10 to the resulting structure.

In addition to providing a capacity to provide temporary connections to mounting guides, connecting features 44 may provide additional stiffness to exterior receiver surface 16 and/or sidewalls 17. In some embodiments, connecting features 44 may also help to prevent the ingress of moisture into concrete structures at the junctions between fastener-receiving component 10 and the concrete structure. In the illustrated embodiment, temporary connecting features 44 of fastener-receiving component 10 comprise male protrusion-type connector components which may connect temporarily (e.g. by snap-together connection) to corresponding female socket-type or hook-type connector components on mounting guides. In other embodiments, temporary connecting features 44 of fastener-receiving component 10 may comprise female socket-type or hook-type connector components for temporary connection to corresponding male protrusion-type connector components on mounting guides. Temporary connecting features 44 are not necessary and may be omitted from some embodiments of fastener-receiving component 10.

FIGS. 2A-2D illustrate a particular exemplary embodiment of a method for anchoring fastener-receiving component 10 to a concrete structure during the fabrication of the concrete structure wherein fastener-receiving component 10 is anchored to the concrete structure as the concrete cures. As shown best in FIG. 2A, in the illustrated embodiment, fastener-receiving component 10 is temporarily connected to form-work component(s) 100 with the help of an optional mounting guide 110. Form-work components 100 may comprise any suitable form-work components that may be used to cast a concrete structure. Non-limiting examples of form-work components 100 include braced plywood form-work components, steel form-work components and the like.

Mounting guide 110 may be a relatively thin component and may be fabricated from materials, and using processes, similar to the materials and processes used to fabricate fastener-receiving component 10. Like fastener-receiving component 10, mounting guide 110 may be elongated in the longitudinal direction (see arrow 12 of FIG. 1A). Mounting guide 110 may comprise an interior guide surface 112, at least a portion of which is shaped to be complementary to exterior receiver surface 16 of fastener-receiving component 10. In the illustrated embodiment, interior guide surface 112 of mounting guide 110 comprises grooves 118A, 118B, 118C, 118D (collectively, grooves 118) and ridges 120A, 120B (collectively, ridges 120) which are complementary to ridges 18 and grooves 120 of exterior receiver surface 16 of fastener-receiving component 10. In some embodiments, grooves 118 and ridges 120 are not necessary and interior guide surface 112 may be substantially flat. In some embodiments, for example where exterior receiver surface 16 has other shapes, interior guide surface 112 may have other shapes.

Mounting guide 110 may optionally comprise temporary connecting features 114A, 114B (collectively, connecting features 114). In the illustrated embodiment, temporary connecting features 114 comprise hooks 115A, 115B (collectively, hooks 115) which extend inwardly and which are located and shaped to be complementary to temporary connecting features 44 of fastener-receiving component 10. As discussed above in relation to temporary connecting features 44 of fastener-receiving component 10, in other embodiments, temporary connecting features 114 of mounting guide 110 may comprise male-protrusion type connector components which engage female socket-type or hook-type connector components on fastener-receiving component 10. In currently preferred embodiments, at least one of temporary connecting features 44, 114 is resiliently deformable such that it may be deformed to connect to the other one of temporary connecting features 44, 114, using a "snap-together" type connection wherein restorative deformation forces (i.e. forces that tend to restore a deformed component to its original shape) act to secure or reinforce the connection. This is not necessary, however, and connection methodologies other than snap-together connections may be used to make connections between temporary connecting features 44, 114.

Figure 2A:
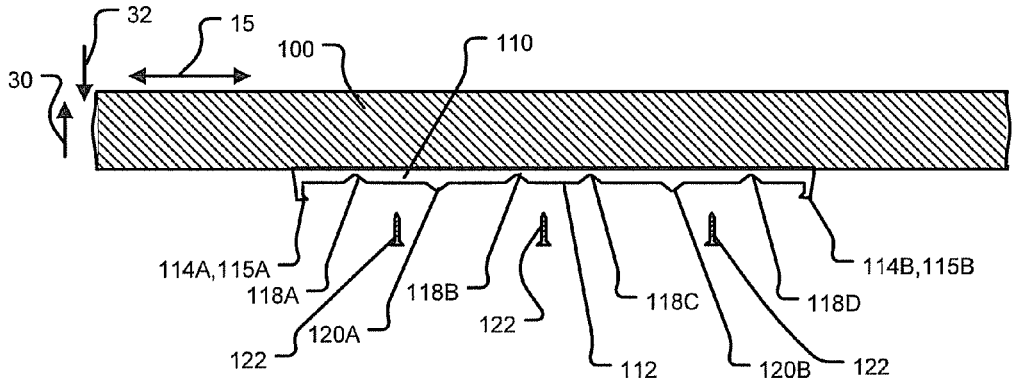
FIGS. 2A-2D illustrate a cross-sectional view of a mounting guide according to a particular embodiment and a particular exemplary embodiment of a method for anchoring the FIG. 1A fastener-receiving component to a concrete structure during the fabrication of the concrete structure.

In use, mounting guide 110 is coupled to the interior surface of one or more form-work components 100 in a desired location as shown in FIG. 2A. Mounting guide 110 may be coupled form-work component(s) 100 using any suitable fastening technique, including penetrative fasteners (e.g. screws, staples, nails or the like), suitable adhesives (e.g. glues, epoxies or the like), hook and loop fasteners or the like. In the illustrated embodiment, mounting guide 110 is coupled to form-work component(s) 100 using countersunk screw 122 which project through mounting guide 110 and into form-work component(s) 100.

Figure 2B:
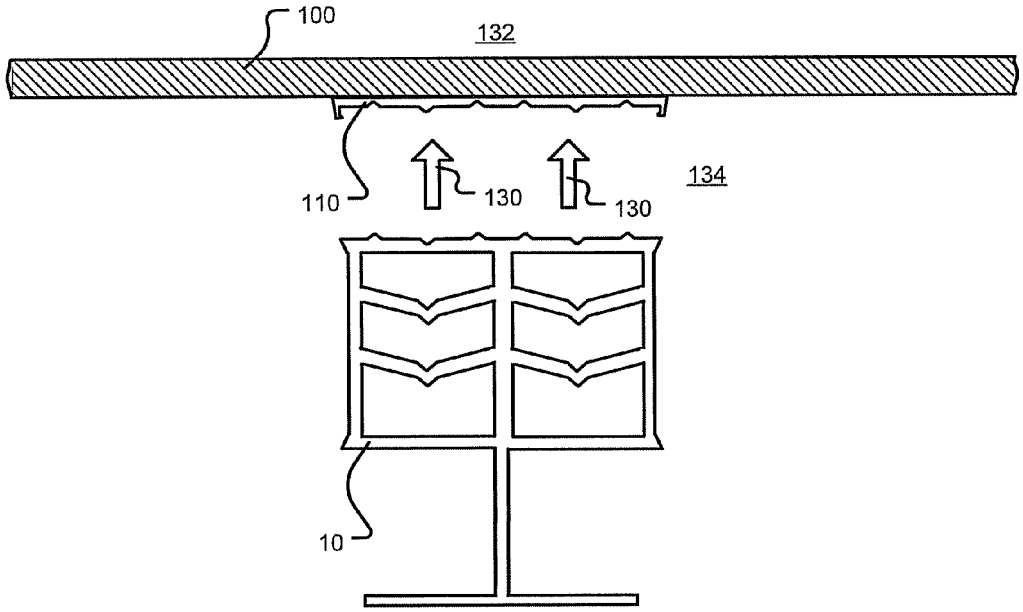
Figure 2C:
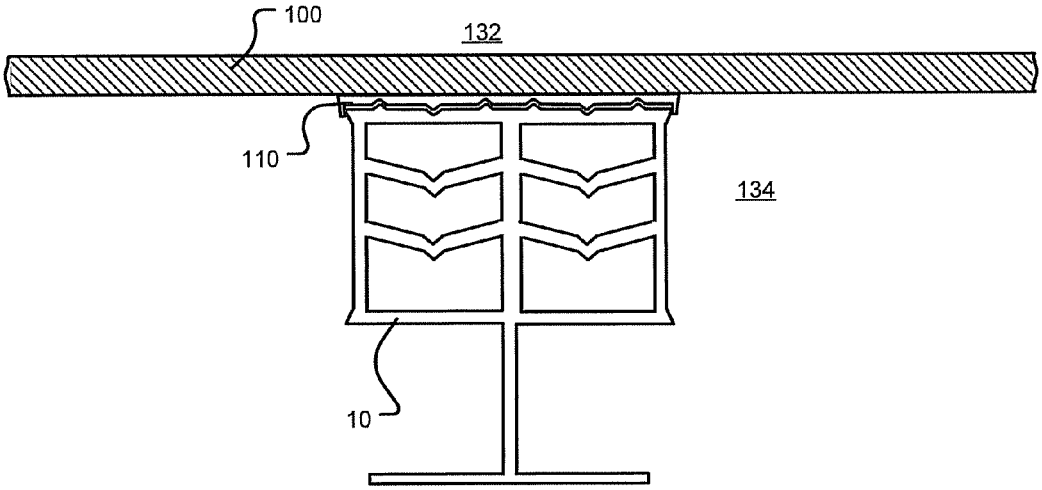

After mounting guide 110 is coupled to form-work component 100, fastener-receiving component 10 may be temporarily mounted to mounting guide 110 as shown in FIGS. 2B and 2C. In the illustrated embodiment, fastener-receiving component 100 is temporarily mounted to mounting guide 110 by pushing fastener-receiving component 10 against mounting guide 110 (as indicated by arrows 130) and thereby forming a snap-together connection between connecting features 44 of fastener-receiving component 10 and connecting features 114 of mounting guide 110. When fastener-receiving components 10 are connected to mounting guides 110, exterior receiver surface 16 (and its ridges 118 and grooves 20) may abut against interior guide surface 112 (and its groovers 118 and ridges 120) as shown in FIG. 2C. Once fastener-receiving components 10 are mounted to mounting guides 110 as shown in FIG. 2C, it will be appreciated that fastener-receiving components 10 are effectively connected to form-work component(s) 100.

Mounting guides 110 are not necessary. In some embodiments, fastener-receiving components 10 may be temporarily connected directly to form-work components 100 using suitable fastening techniques, which may include, by way of non-limiting example, penetrative fasteners (e.g. screws, staples, nails or the like), suitable adhesives (e.g. glues, epoxies or the like), hook and loop fasteners or the like. For example, screws may be used to mount fastener receiving components 10 directly to form-work component(s) 100 by projecting from an exterior side 132 of form-work components 100 through to an interior side 134 of form-work components 100 and into exterior receiver surface 16, into fastener-receiving channels 14 and/or into temporary connector features 44. To the extent that such fasteners project into fastener-receiving channels 14, it is currently preferred that such fasteners do not penetrate too deeply into fastener-receiving channels 14 (e.g. not through an excessive number of break-through elements 22), as this will preserve the integrity of break-through elements 22 for receiving fasteners once the concrete structure is formed.

As discussed above, temporary connecting features 114 of mounting guide 110 are optional. In some embodiments, mounting guide 110 may be provided with interior guide surface 112 without temporary connecting features 114. In such embodiments, interior guide surface 112 may be used to align fastener-receiving components 10 (e.g. by abutting exterior receiver surface 16 (and its ridges 118 and grooves 20) against interior guide surface 112 (and its groovers 118 and ridges 120)). However, in such embodiments, fastener-receiving component 10 may be temporarily mounted to form-work component(s) 100 using suitable fastening techniques other than via the connection between temporary connecting features 44, 114.

In still other embodiments, fastener-receiving components 10 can be located within a concrete structure by coupling to rigid structures other than foam-work component(s) 100 or mounting guides 110. By way of non-limiting example, fastener-receiving components 10 may be coupled to rebar or to other rigid structures inside or outside of the form-work assembly.

Once fastener-receiving components 10 are temporarily mounted to form-work component(s) 100, form-work components 100 may be assembled to provide a form-work assembly (not shown) for the concrete structure to be fabricated. It will be appreciated that the precise nature of the form-work assembly depends on the nature of the concrete structure to be fabricated. There are many techniques, apparatus and methods for assembling form-works in which concrete structures may be fabricated. These techniques, apparatus and methods are well known in the art and are not detailed in this description. It should be understood, however, that fastener-receiving component 10 may be used to fabricate pre-cast concrete structures (i.e. concrete structures that are fabricated in one location/orientation and then moved to a subsequent location/orientation for use) and cast-in-place concrete structures (i.e. concrete structures that are formed in the location/orientation in which they will be used).

In some applications (e.g. where the concrete structures are sufficiently large or where it is otherwise possible to access an interior of the form-work assembly), mounting guides 110 may be coupled to form-work component(s) 100 and/or fastener-receiving components 10 may be temporarily mounted to mounting guides 110 or to form-work component 100 after the form-work component are assembled to provide the form-work in which the concrete structure will be formed.

Figure 2D:
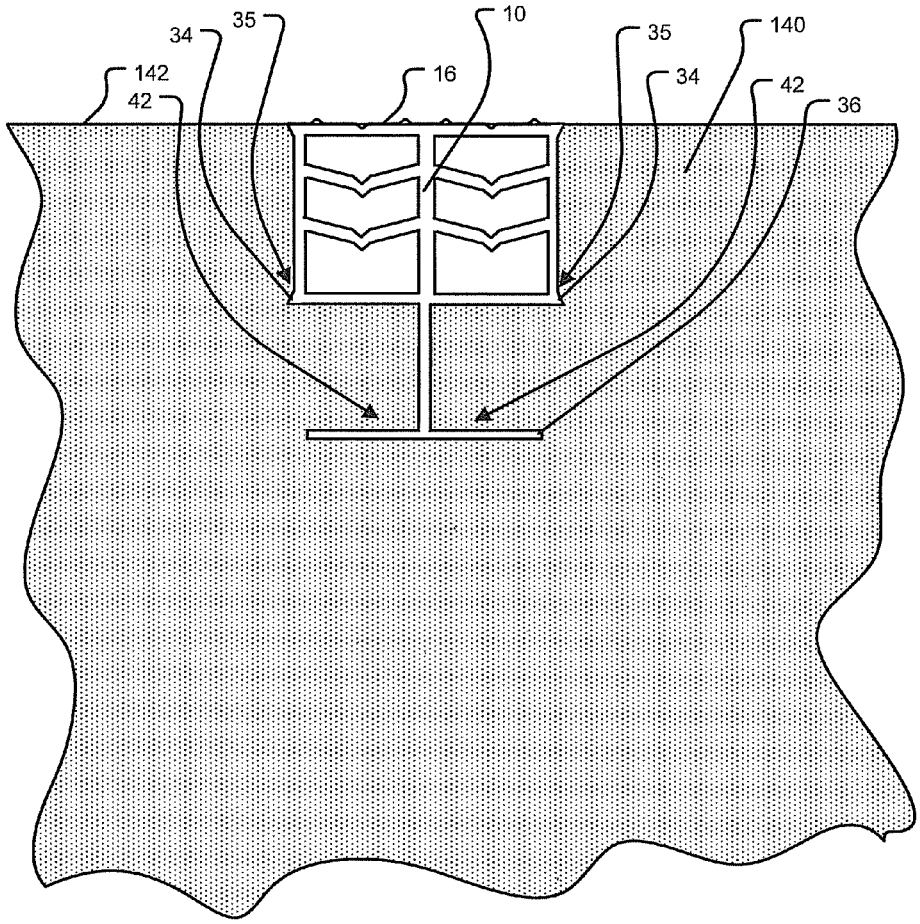

When the form-work assembly is assembled and ready to accept concrete, then concrete may be introduced to the form-work assembly. The liquid concrete will fill the gaps in the form-work assembly including, for example, concavities 42 defined by anchor portion 36 and concavities 35 defined by transverse anchoring protrusions 34. The concrete in the form-work assembly is then permitted to cure. Once the concrete is cured, the form-work assembly is removed from the resultant concrete structure 140 and fastener-receiving component 10 is anchored in concrete structure 140 as shown in FIG. 2D. As the concrete cures to form concrete structure 140, the concrete located in concavities 42, 35 helps to anchor fastener-receiving component 10 to concrete structure 140.

It will be appreciated by observing FIG. 2D, that, in the illustrated embodiment, once concrete structure 140 cures, exterior receiver surface 16 of fastener-receiving component 10 is located at least approximately in the same plane as exterior structure surface 142 (i.e. the exterior surface 142 of concrete structure 140). In this manner, fastener-receiving component 10 may be used as described above to receive fasteners (see FIG. 1D) and to mount external objects (not shown) to concrete structure 140.

When temporarily mounting fastener-receiving components 10 to mounting guides 110 and/or to form-work component(s) 100, fastener-receiving components 10 may be arranged in any desired locations and/or arrangement on form-work components 100, it being recognized that the locations of fastener-receiving components 10 relative to form-work component(s) 100 will determine the eventual locations and arrangement of fastener-receiving components 10 in the resultant concrete structure.

Figure 3A:
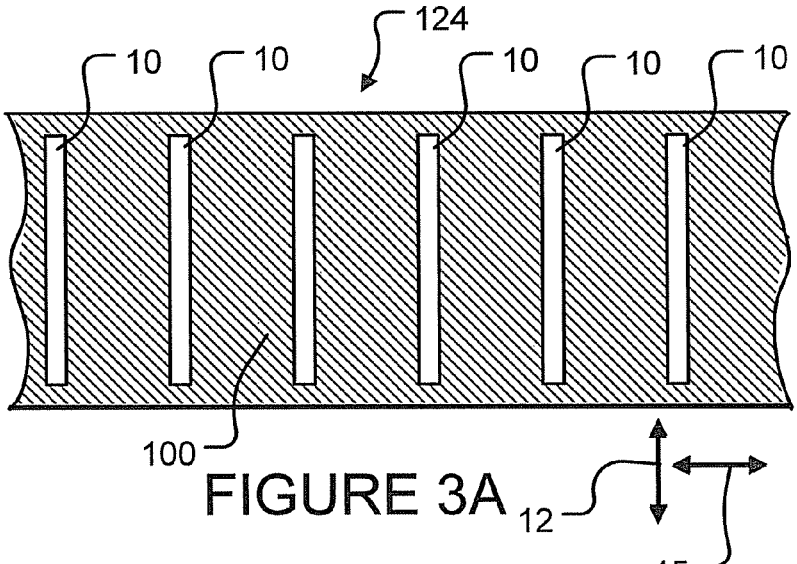
FIGS. 3A, 3B and 3C schematically illustrate a number of exemplary arrangements of fastener-receiving components relative to a form-work component.
Figure 3B:
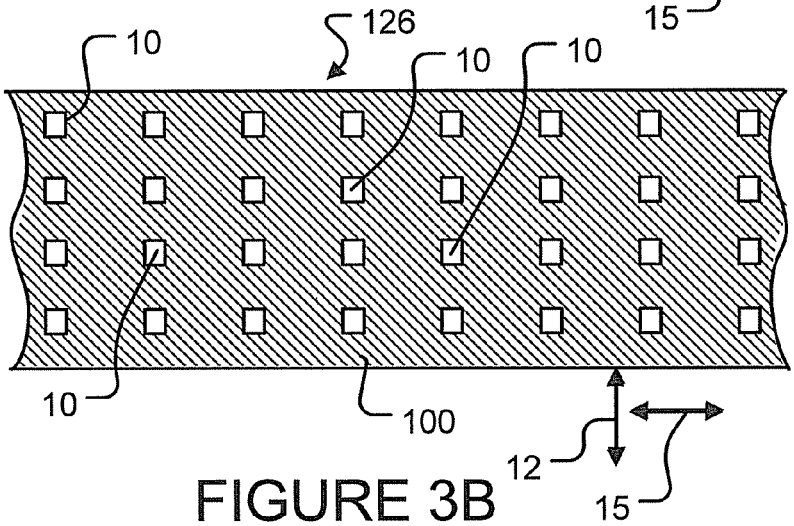
Figure 3C:
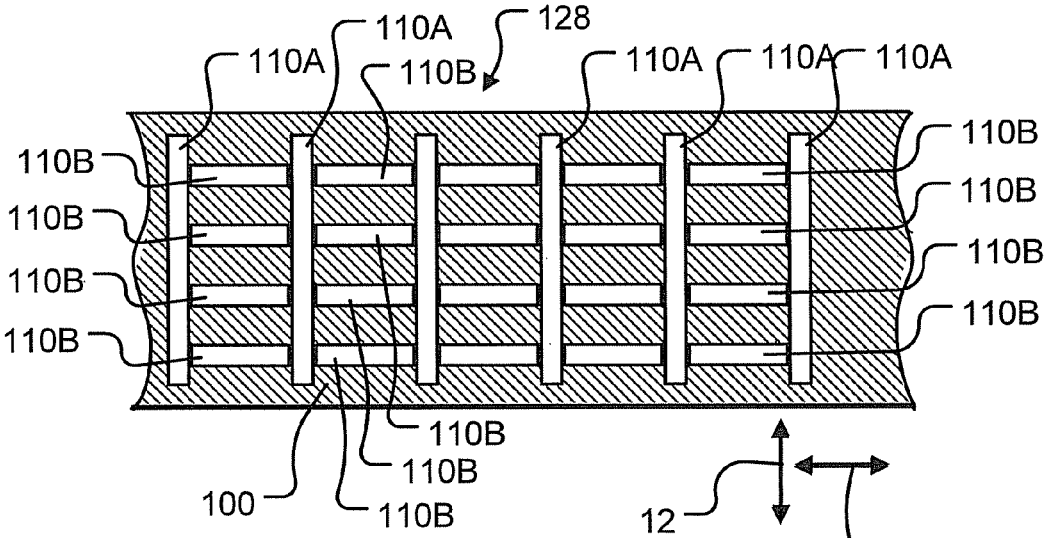

FIGS. 3A-3C schematically illustrate a number of suitable (but non-limiting) arrangements which may be used for mounting fastener-receiving components 10 to mounting guides 110 and/or to form-work component(s) 100. In arrangement 124 of FIG. 3A, fastener-receiving components 10 are elongated in longitudinal direction (arrow 12) are spaced apart from one another in transverse direction (arrow 15). As discussed above, fastener-receiving components 10 may be of substantially uniform cross-section (with the exception of apertures 39) in longitudinal direction 12. The FIG. 3A arrangement 124 of fastener-receiving components 10 is similar to the arrangement of studs in the framing of a conventional wood-frame wall and may be used, by way of non-limiting example, where the concrete structure is a wall and it is desired to mount a wall covering or fascia to the wall.

In arrangement 126 of FIG. 3B, fastener-receiving components 10 are approximately the same size in their longitudinal dimension (arrow 12) and transverse dimension (arrow 15). As shown in FIG. 3B, fastener-receiving components are spaced apart from one another in both the longitudinal and transverse directions to provide a two-dimensional array of locations where fasteners can be received in the resultant concrete structure. In arrangement 128 of FIG. 3C, fastener-receiving components 10 are arranged to provide an intersecting lattice of fastener-receiving components 10A that are elongated in longitudinal direction 12 and fastener-receiving components 10B that are elongated in transverse direction 15. The intersecting lattice of fastener-receiving components 10 in arrangement 128 of FIG. 3C may provide some additional structural integrity to the resultant concrete structure. It will be appreciated by those skilled in the art that the arrangements 124, 126, 128 of fastener-receiving components 10 schematically depicted in FIGS. 3A-3C represent a number of non-limiting example arrangements and that fastener-receiving components 10 could be provided in other arrangements.

Figure 4A:
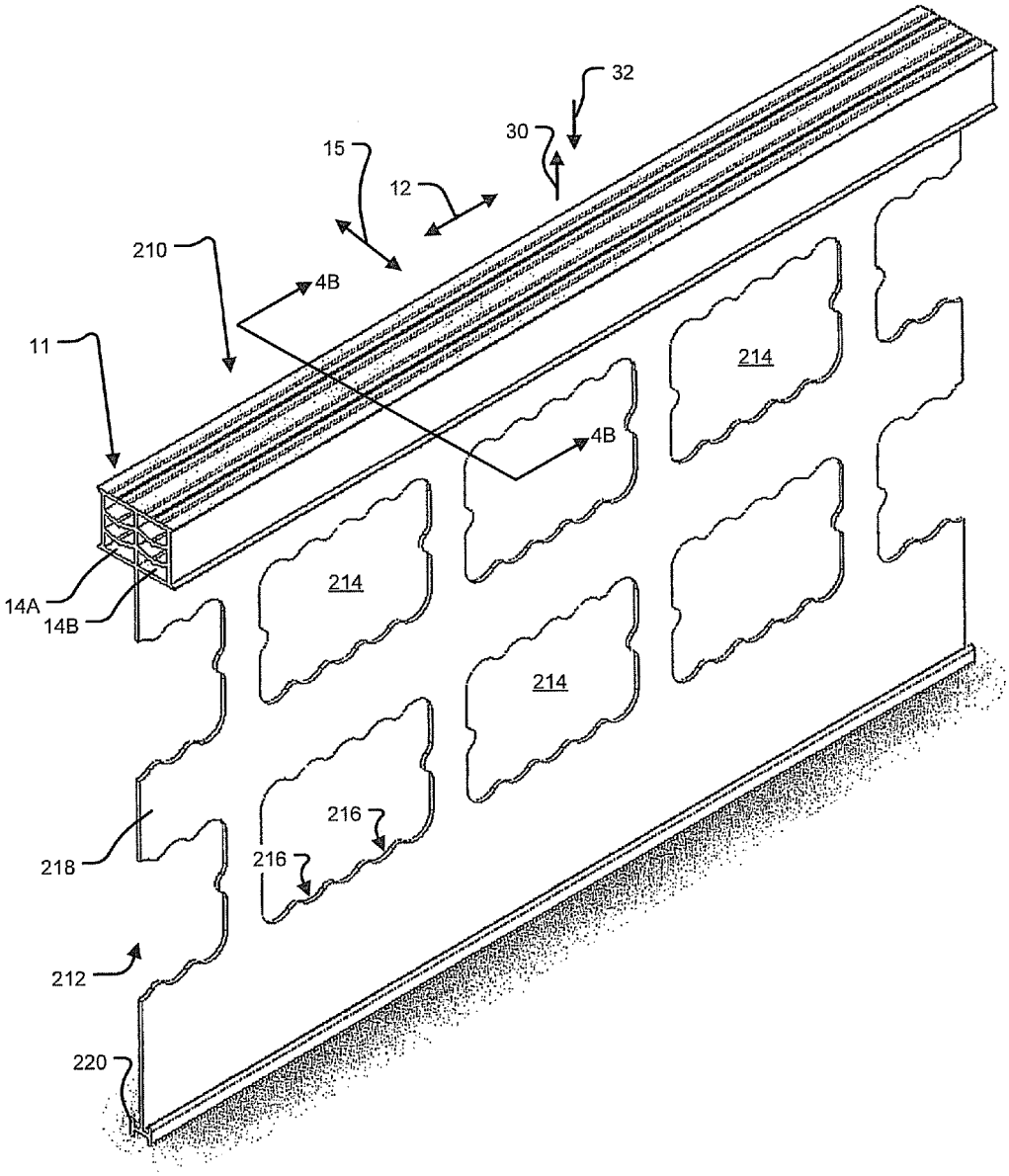
FIG. 4A is an isometric view of a fastener-receiving component according to another embodiment of the invention.
Figure 4B:
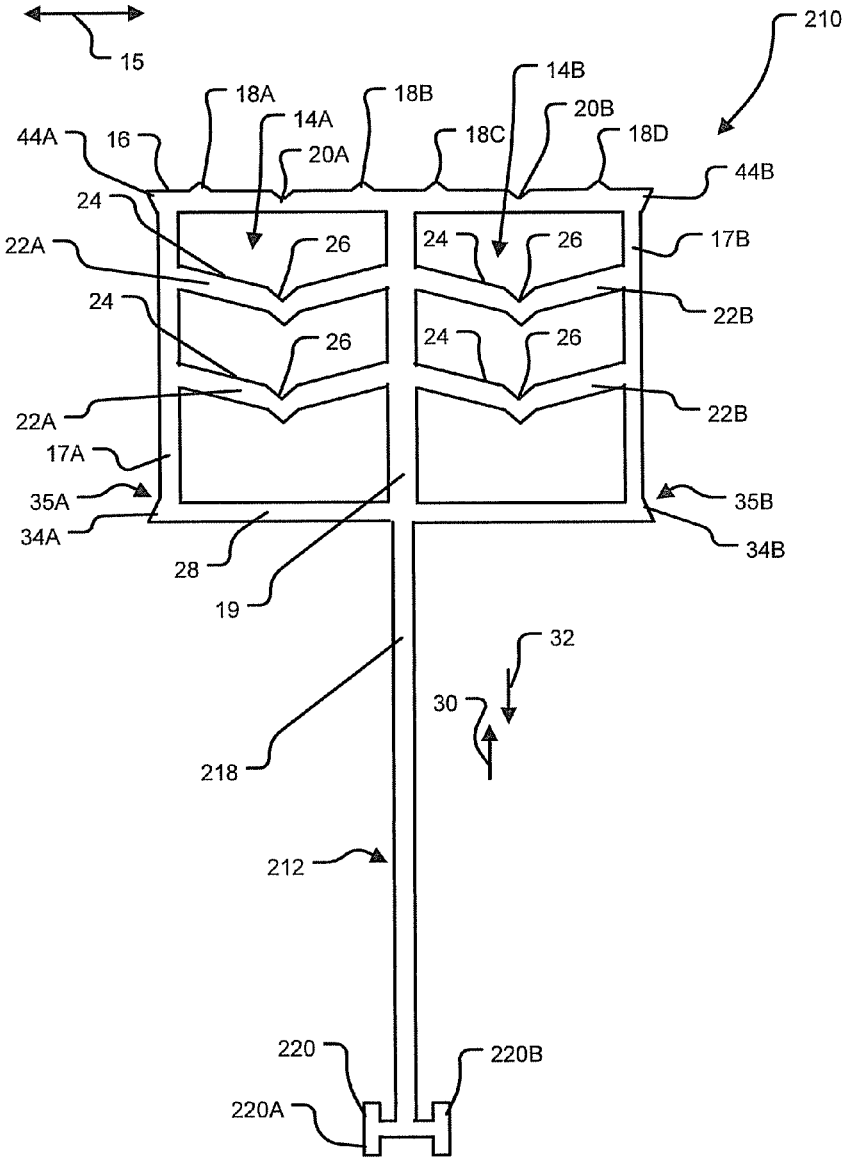
FIG. 4B is a cross-sectional view of the FIG. 4A fastener-receiving component taken along the line 4B-4B.

FIGS. 4A and 4B respectively depict isometric and cross-sectional views of a fastener-receiving component 210 according to another embodiment of the invention. Fastener-receiving component 210 is substantially similar to fastener-receiving component 10 in many respects. In particular, fastener-receiving component 210 comprises a fastener-receiving portion 11 that is substantially similar to fastener-receiving portion 11 of fastener-receiving component 10 described above and similar reference numerals are used in FIG. 4B to indicate similar features. Fastener-receiving component 210 differs from fastener-receiving component 10 in that fastener-receiving component 210 comprises a through-connector portion 212 in the place of anchor portion 36 of fastener-receiving component 10. As is explained in more detail below, through-connector portion 212 may be used to connect to structure-lining panels on the interior surface of a concrete structure (i.e. the surface of a concrete structure that is opposed to the side that fastener-receiving portion 11 (and exterior fastener surface 16) are exposed to.

In the illustrated embodiment, through-connector portion 212 comprises a stem 218 which extends inwardly (the direction of arrow 32) from fastener-receiving portion. Stem 218 defines one or more apertures 214 through which liquid concrete may flow. At the inward end of stem 218, through-connector portion 218 comprises one or more connector components 220. In the illustrated embodiment, connector components 220 comprise a pair of male T-shaped connector components 220A, 220B which, as explained in more detail below, are slidably connectable to correspondingly shaped female connector components on structure-lining panels. In other embodiments, connector component(s) 220 of through-connector portion 212 may comprise other shapes of slidable connector components (e.g. connector components could comprise female slidable connector components which may be J-shaped or C-shaped, for example) or other types of connector components (e.g. snap-together connector components or the like).

Figure 5A:
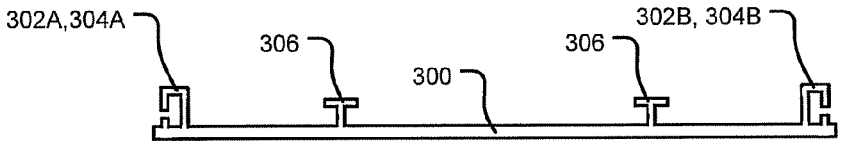
FIG. 5A is a cross-sectional view of a first type of structure-lining panel.
Figure 5B:
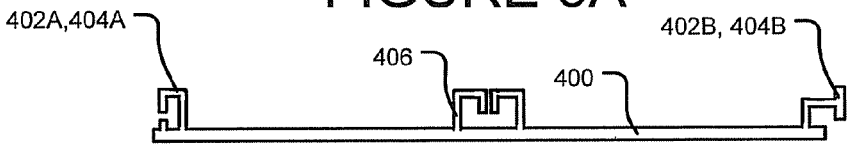
FIG. 5B is a cross-sectional view of a second type of structure-lining panel.

Through-connector portion 212 may extend through a concrete structure to attach to one or more structure-lining panels on the interior side of the structure. FIGS. 5A and 5B respectively illustrate cross-sectional views of a pair of panels 300, 400 suitable for use with fastener-receiving component 210 and through-connector portion 212. The illustrated views of FIGS. 5A and 5B are cross-sectional views cut across a longitudinal dimension of panels 300, 400 (i.e. the longitudinal dimension of panels 300, 400 is into and out of the page in FIGS. 5A, 5B). Panels 300, 400 may have substantially uniform cross-sections along their longitudinal dimensions. Panels 300, 400, may be fabricated from materials, and using processes, similar to the materials and processes used to fabricate fastener-receiving component 10.

Panel 300 (FIG. 5A) comprises a pair of connector components 302A, 302B (collectively, connector components 302) at its transverse edges 304A, 304B (collectively, edges 304). In the illustrated embodiment, connector components 302 of panel 300 comprise female C-shaped connector components 302, each of which may be slidably engaged with corresponding T-shaped connector components 220A, 220B of through-connector portion 212. In other embodiments, connector component(s) 302 may comprise other shapes of slidable connector components or other types of connector components, depending on the shape and/or type of connector components 220 on through-connector portion 212 of fastener-receiving component 210. In the illustrated embodiment, panel 300 also comprises a pair of anchor components 306 which may help anchor panel 300 to the concrete structure as the concrete structure cures. Anchor components 306 and their functionality is explained in detail in U.S. application Ser. No. 12/594,576.

Figure 5C:
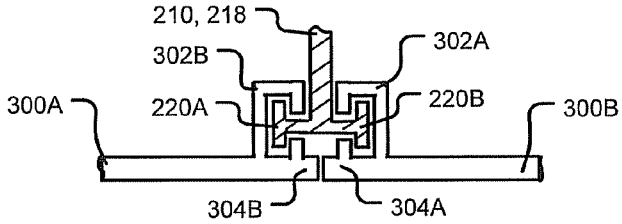
FIG. 5C is a magnified view showing the FIG. 4A fastener-receiving component used to connect a pair of the FIG. 5A panels in edge-adjacent relationship.

In use, fastener-receiving component 210 and its through-connector portion 212 are coupled to a pair of edge-adjacent panels 300 as is shown in detail in FIG. 5C. FIG. 5C shows a portion of a first panel 300A, a portion of an edge-adjacent panel 300B and a portion of through-connector portion 212 of fastener-receiving component 210. As shown in FIG. 5C, T-shaped connector component 220A of fastener-receiving component 210 may be slidably inserted into corresponding C-shaped connector component 302B of panel 300A. Similarly, T-shaped connector component 220B of fastener-receiving component 210 may be slidably inserted into corresponding C-shaped connector component 302A of panel 300B. In this manner, fastener-receiving component 210 is used as a connector to connect panels 300A, 300B to one another in edge-adjacent relationship (i.e. edge 304A of panel 300B is adjacent to edge 304B of panel 300A). In the language of U.S. application Ser. No. 12/594,576, fastener-receiving component 210 is a "connector-type" anchoring component 210 as it connects a pair of panels 300A, 300B in an edge-adjacent relationship.

Figure 5D:
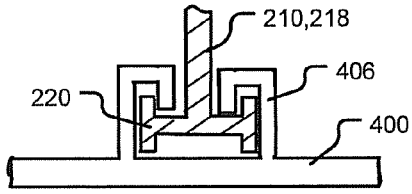
FIG. 5D is a magnified view showing the FIG. 4A fastener-receiving component connected to a corresponding connector component on the FIG. 5B panel.
Figure 5E:
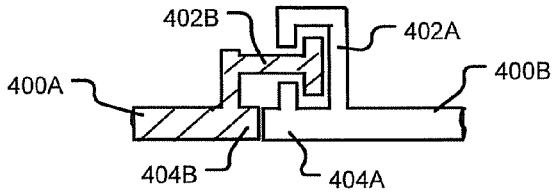
FIG. 5E is a magnified view showing a pair of the FIG. 5B panels connected to one another in edge-adjacent relationship.
Figure 5F:
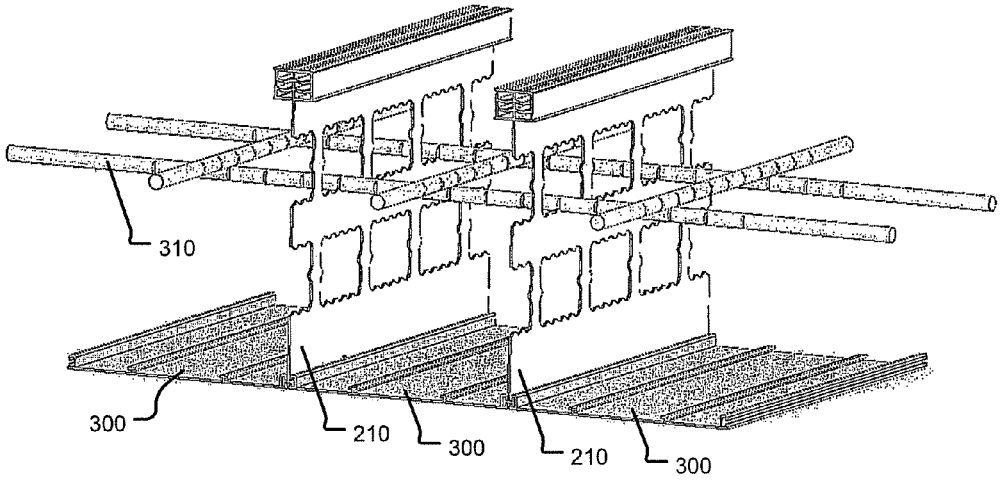
FIG. 5F is an isometric view showing the FIG. 4A fastener-receiving component as a connector-type anchoring component according to a particular embodiment.

FIG. 5F illustrates the use of fastener-receiving component 210 as a connector-type anchoring component according to a particular embodiment. In the FIG. 5F illustration, a pair of fastener-receiving components 210 connect three panels 300 to one another in edge-adjacent relationship. Panels 300 and fastener-receiving components 210 may be connected together as described above. Panels 300 may abut against one or more form-work component(s) (not shown) which will define an interior surface of the resultant concrete structure. Exterior receiver surfaces 16 of fastener-receiving components 210 may abut against one or more form-work components (not shown) on the opposite side of the form-work assembly which will define an exterior surface of the resultant concrete structure. Because fastener-receiving components 210 are connected to panels 300, there is no need to temporarily mount fastener-receiving components 210 to the form-work components using mounting guides or the like.

In some applications (e.g. where the structure being fabricated is a tilt-up wall), it is not necessary that there be form-work components abutting against fastener-receiving components 210, since gravity will retain the concrete in the form. In the illustrated embodiment, rebar 310 extends through apertures 214 in fastener-receiving components 210, although rebar 310 is not necessary.

Concrete is then introduced to the form-work assembly. The liquid concrete fills the gaps in the form-work assembly. As described above for fastener-receiving components 10, fastener-receiving components 210 may be anchored to the concrete as it cures. In addition to the anchoring features of fastener-receiving components 10, fastener-receiving components 210 may be anchored to the resultant concrete structure by panels 300. Panels 300 may be anchored to the resultant concrete structure in a similar manner by their integral anchoring features 306. Panels 300 may also be anchored to the resultant concrete structure as it cures by the anchoring effect of fastener-receiving components 210 and in particular the transverse extension of fastener-receiving portion 11 atop through-connector portion 212.

When the concrete cures and the form-work assembly is removed, the resultant structure comprises a lining (made up of panels 300) on its interior side and a number of locations to which fasteners may be anchored (to fastener-receiving channels 14 of fastener-receiving components 210) on its exterior side.

Panel 400 (FIG. 5B) comprises a pair of complementary connector components 402A, 402B (collectively, connector components 402) at its transverse edges 404A, 404B (collectively, edges 404). In the illustrated embodiment, connector components 402 of panel 400 comprise complementary male T-shaped connector components 402B and female C-shaped connector components 402A, which may be slidably engaged with one another to connect panels 400 directly to one another in an edge-adjacent relationship as explained in more detail below. In other embodiments, connector component(s) 402A, 402B may comprise other shapes of slidable complementary connector components or other types of complementary connector components. Panel 400 may also comprise one or more connector components 406 which may be used to connect to complementary connector components 220 of through-connector portion 212 of fastener-receiving component 210. In the illustrated embodiment, connector components 406 of panel 400 comprise a pair of female C-shaped connector components, each of which may be slidably engaged with corresponding T-shaped connector components 220A, 220B of through-connector portion 212. In other embodiments, connector component(s) 406 may comprise other shapes of slidable connector components or other types of connector components, depending on the shape and/or type of connector components 220 on through-connector portion 212 of fastener-receiving component 210.

In use, fastener-receiving component 210 and its through-connector portion 212 are connected to connector components 406 of panels 400 as is shown in detail in FIG. 5D. In the illustrated embodiment, T-shaped male connector components 220 of fastener-receiving component 210 slide into complementary female C-shaped connector components 406 of panel 400. In the language of U.S. application Ser. No. 12/594,576, fastener-receiving component 210 is a "connectable-type" anchoring component 210 as it connects a single panels 400. In addition to connecting fastener-receiving component 210 to panel 400, panels 400 are directly connected to one another in edge-adjacent relationship as shown in detail in FIG. 5E. FIG. 5E shows a portion of a first panel 400A and a portion of an edge-adjacent panel 400B. As shown in FIG. 5E, T-shaped connector component 402B panel 400A may be slidably inserted into corresponding C-shaped connector component 402A of panel 400B.

The use of fastener-receiving components 210 in conjunction with panels 400 is similar to the use of fastener-receiving components 210 with panels 300 described above and shown in FIG. 5F, except that fastener-receiving components 210 are each connected to a single panel 400 and edge-adjacent panels 400 are connected directly to one another. As concrete is introduced to the form-work assembly and begins to cure, fastener-receiving components 210 are anchored to the concrete as it cures. Fastener-receiving components 210 may also be anchored to the resultant concrete structure by their connection to panels 400. Panels 400 may be anchored to the resultant concrete structure as it cures by the anchoring effect of fastener-receiving components 210 and in particular the transverse extension of fastener-receiving portion 11 atop through-connector portion 212. When the concrete cures and the form-work assembly is removed, the resultant structure comprises a lining (made up of panels 400) on its interior side and a number of locations to which fasteners may be anchored (to fastener-receiving channels 14 of fastener-receiving components 210) on its exterior side.

As will be apparent to those skilled in the art in the light of the foregoing disclosure, many alterations and modifications are possible in the practice of this invention without departing from the spirit or scope thereof For example:

In the embodiments described herein, the structural material used to fabricate structures is concrete. This is not necessary. In some applications, fastener-receiving components 10 described herein may be used in connection with structures formed from other structural materials (e.g. other cementitious materials or other curable materials) which may initially be introduced into forms and may subsequently solidify or cure. It will be understood that references to concrete in this description should be understood to incorporate such other cementitious or curable materials.

Any of the connections formed by connector components described herein may be varied by reversing the connector components (e.g. replacing male connector components with female connector components and vice versa). Connections fanned by slidable connector components may be implemented by providing connector components having other mating shapes which are slidable.

Any of the connector components described herein may be varied to provide other types of connector components for connecting parts of structure-lining apparatus to one another. By way of non-limiting example, such connector components may form slidable connections, deformable "snap-together" connections, pivotable connections, or connections incorporating any combination of these actions. By way of non-limiting example, a number of suitable pivotable and deformable snap-together connections are described in co-owned U.S. application No. 60/986973 and a number of suitable slidable, pivotable and deformable snap-together connections are described in co-owned U.S. application No. 61/022505.

Concrete structures incorporating fastener-receiving components may incorporate thermal and/or sound proofing insulation. Techniques for incorporating such insulation are described in Ser. No. 12/594,576.

Figure 9:
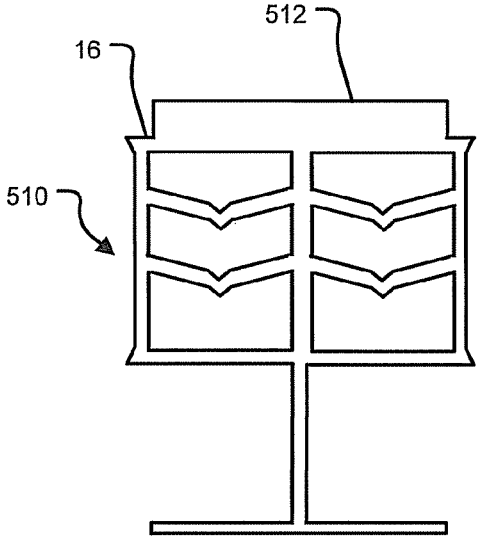
FIG. 9 shows a fastener-receiving component with a standoff on its exterior receiver surface which may be used to provide an air channel between a concrete structure and an object mounted to the concrete structure using the fastener-receiving component.

FIG. 9 illustrates a fastener-receiving component 510 according to another embodiment wherein its exterior receiver surface 16 comprises an outwardly protruding standoff 512. When temporarily connected to form-work member(s), the form-work members may be provided with a groove shaped to accommodate standoff 512. This may serve the purpose of aligning fastener-receiving component 510 on the form-work component. This may also allow the remainder of exterior receiver surface 16 to be substantially flush against the form-work component(s). When the concrete structure is formed, standoff 512 will project outwardly from (i.e. be proud of) the resultant structure. This projection of standoff 512 may permit an object to be mounted to the concrete structure (via projection of a fastener into fastener-receiving component 510), while providing an air gap between the mounted object and the concrete structure. Such an air gap may provide ventilation for example.

While fastener-receiving components are shown in the drawings as being connector type anchoring features which connect a pair of panels to one another in edge-adjacent relationship and connectable-type anchoring features which connect to a single panel wherein the edge-adjacent panels connect directly to one another, it is also possible (although not shown in the illustrated embodiments) that fastener-receiving components could be integrally formed with panels.

In particular embodiments described herein, structure-lining panels 300, 400 are described to extend in a longitudinal direction (arrow 12) and in a transverse direction (arrow 15) to provide generally planar structure-lining panels. This is not necessary. In some embodiments, the panels may be fabricated with some curvature to line a correspondingly curved structural form or may be deformed to line a correspondingly curved structural form and to thereby provide a curved structure-lining surface. In particular embodiments, this curvature will be in the transverse direction such that panels remain substantially unchanged in the longitudinal direction. In such embodiments, it will be appreciated that both the precise transverse direction(now a tangential direction) and the precise inward/outward directions (now a radial direction) will depend on where (i.e. the point on the panel) such directions are being assessed. In other embodiments, this curvature may be in the longitudinal direction such that panels remain substantially unchanged in the transverse direction.

It will be appreciated that for lining general structures as described herein, the longitudinal, transverse and inward/outward directions described herein may have any particular orientations depending on the orientation of the form in which the structure is cast.

Accordingly, the scope of the invention should be defined in accordance with the substance defined by the following claims.

What is claimed is:

1. A method providing a fastener-receiving component in a structure fabricated from a curable material, the method comprising:

providing a fastener-receiving component comprising: one or more fastener-receiving channels, each fastener-receiving channel defined by a pair of longitudinally and inwardly extending sidewalls and comprising one or more break-through elements which extend longitudinally and transversely between the sidewalls for receiving fasteners that penetrate therethrough; and one or more anchor features;

providing each of the one or more break-through elements with a concave outward surface, thereby helping to retain fasteners projected through the one or more break-through elements from being withdrawn in an outward direction;

embedding at least a portion of the one or more anchor features in the material when the material is a liquid, the portion of the one or more anchor features defining one or more corresponding concavities shaped to receive the liquid material when the structure is formed and to prevent outward movement of the fastener-receiving component when the liquid material cures; and anchoring the fastener-receiving component to the material as the material cures.

2. A method according to claim 1 wherein the one or more break-through elements comprise a plurality of break-through elements inwardly spaced apart from one another.

3. A method according to claim 1 comprising providing each of the one or more break-through elements with a groove region where the slope of the concavity is relatively sharp in comparison to other regions of the concave outward surface and thereby guiding the projection of the one or more fasteners through the corresponding break-through element.

4. A method according to claim 1 comprising:

providing a mounting guide that is coupleable to one or more form-work components used to fabricate the structure; and connecting, at least temporarily, one or more connection features of the fastener-receiving component to one or more complementary features on the mounting guide.

5. A fastener-receiving component for use in a structure fabricated from a curable material, the fastener-receiving component comprising:

one or more fastener-receiving channels, each fastener-receiving channel defined by a pair of longitudinally and inwardly extending sidewalls and comprising one or more break-through elements which extend longitudinally and transversely between the sidewalls for receiving fasteners that penetrate therethrough;

one or more anchor features that define one or more corresponding concavities shaped to receive liquid material when the structure is formed and to prevent outward movement of the fastener-receiving component when the liquid material cures; and wherein each of the one or more break-through elements comprises a concave outward surface, the concave outward surface for helping to retain fasteners projected through the one or more break-through elements from being withdrawn in an outward direction.

6. A fastener-receiving component according to claim 5 wherein the concave outward surface comprises a groove region where the slope of the concavity is relatively sharp in comparison to other regions of the concave outward surface.

7. A fastener-receiving component according to claim 5 wherein the one or more break-through elements comprise a plurality of break-through elements that are inwardly spaced apart from one another.

8. A fastener-receiving component according to claim 5 comprising an exterior receiver surface at an exterior end of the fastener-receiving channels, wherein fasteners are projectable through the exterior receiver surface and into one of the one or more fastener-receiving channels.

9. A fastener-receiving component according to claim 8 wherein the exterior receiver surface comprises one or more longitudinally and outwardly projecting ridges.

10. A fastener-receiving component according to claim 9 wherein the exterior receiver surface comprises one or more longitudinally and inwardly extending grooves.

11. A fastener-receiving component according to claim 5 wherein the one or more anchor features comprise one or more transversely extending anchoring protrusions which extend longitudinally and transversely away from one of the sidewalls to define one or more corresponding concavities between the transversely extending anchoring protrusions and the one of the sidewalls.

12. A fastener-receiving component according to claim 5 wherein the one or more anchor features comprises: a stem that projects longitudinally and inwardly from an innermost extent of the one or more fastener-receiving channels; and one or more leaves that extend longitudinally and transversely away from the stem to define one or more corresponding concavities between the leaves and the stem.

13. A fastener-receiving component according to claim 12 wherein the stem is perforated by one or more apertures that permit the flow of liquid material therethrough.

14. A fastener-receiving component according to claim 5 comprising a through-connection portion comprising a longitudinally and inwardly extending stem and one or more connector components at an inward end of the stem, the one or more connector components shaped to connect to corresponding connector components on one or more structure-lining panels that line an inner surface of the concrete structure.

15. A fastener-receiving component according to claim 14 wherein the one or more connector components are connected to corresponding connector components on a single structure-lining panel.

16. A fastener-receiving component according to claim 14 wherein the one or more connector components are connected to a pair of corresponding connector components belonging to a corresponding pair of structure-lining panels and wherein the connection between the one or more connector components and the pair of corresponding connector components maintains the corresponding pair of structure-lining panels in an edge-adjacent relationship.

17. A kit for anchoring a fastener-receiving component into a structure made of curable material, the kit comprising:

a fastener-receiving component according to claim 5;

a mounting guide that is coupleable to one or more formwork components used to fabricate the structure;

wherein the fastener-receiving component comprises one or more connection features for temporary connection to one or more complementary connection features on the mounting guide.

18. A kit according to claim 17 wherein the one or more connection features on the fastener-receiving component and the one or more complementary connector features on the mounting guide are temporarily connectable to one another using a snap-together fit, wherein at least one of the connector features is deformed and restorative deformation forces effect the connection.

19. A kit according to claim 17 wherein the fastener-receiving component comprises an exterior receiver surface at an exterior end of the fastener-receiving channels, wherein fasteners are projectable through the exterior receiver surface and into one of the one or more fastener-receiving channels.

20. A kit according to claim 19 wherein the exterior receiver surface comprises at least one of: one or more longitudinally and outwardly projecting ridges; and one or more longitudinally and inwardly extending grooves.

21. A kit according to claim 20 wherein the mounting guide comprises an interior mounting surface which abuts against the exterior receiver surface when the fastener-receiving component and mounting guide are temporarily connected, the interior mounting surface comprising at least one of: one or more longitudinally and outwardly extending grooves shaped and located to receive the one or more longitudinally and outwardly projecting ridges on the exterior receiver surface; and one or more longitudinally and inwardly projecting ridges shaped and located to project into the one or more longitudinally and inwardly extending grooves on the exterior receiver surface.

22. A kit for anchoring a fastener-receiving component into a structure made of curable material, the kit comprising:

a fastener-receiving component comprising:

one or more fastener-receiving channels, each fastener-receiving channel defined by a pair of longitudinally and inwardly extending sidewalls and comprising one or more break-through elements which extend longitudinally and transversely between the sidewalls for receiving fasteners that penetrate therethrough;

one or more anchor features that define one or more corresponding concavities shaped to receive liquid material when the structure is formed and to prevent outward movement of the fastener-receiving component when the liquid material cures;

a mounting guide that is coupleable to one or more formwork components used to fabricate the structure;

wherein the fastener-receiving component comprises one or more connection features for temporary connection to one or more complementary connection features on the mounting guide;

wherein the one or more connection features on the fastener-receiving component and the one or more complementary connector features on the mounting guide are temporarily connectable to one another using a snap-together fit, wherein at least one of the connector features is deformed and restorative deformation forces effect the connection.

* * * * *